US006488484B2

(12) United States Patent
Pettenon

(10) Patent No.: US 6,488,484 B2
(45) Date of Patent: Dec. 3, 2002

(54) HYDRAULIC PUMP WITH PERMANENT-MAGNET MOTOR HAVING A PRESET DIRECTION OF ROTATION

(75) Inventor: Paolo Pettenon, Cittadella (IT)

(73) Assignee: Sicce S.p.A., S. Pietro in Gu' (IT)

( * ) Notice: Subject to any disclaimer, the term of this patent is extended or adjusted under 35 U.S.C. 154(b) by 0 days.

(21) Appl. No.: 09/801,691

(22) Filed: Mar. 9, 2001

(65) Prior Publication Data

US 2001/0028855 A1 Oct. 11, 2001

(30) Foreign Application Priority Data

Apr. 7, 2000 (IT) ..... MI00A0763

(51) Int. Cl.[7] ..... F04B 35/04

(52) U.S. Cl. ..... 417/423.1; 417/423.7; 416/223 R; 416/1; 415/1

(58) Field of Search ..... 417/423.1, 423.7; 416/223 R, 3, 1; 415/1

(56) References Cited

U.S. PATENT DOCUMENTS 5,158,440 A * 10/1992 Cooper et al. ..... 417/355
5,714,814 A * 2/1998 Marioni ..... 310/156.12
6,158,984 A * 12/2000 Cao et al. ..... 415/200
6,227,817 B1 * 5/2001 Paden ..... 417/356
6,264,635 B1 * 7/2001 Wampler et al. ..... 417/423.1

* cited by examiner

*Primary Examiner*—Charles G. Freay
*Assistant Examiner*—Emmanuel Sayoc
(74) *Attorney, Agent, or Firm*—Guido Modiano; Albert Josif; Daniel O'Byrne

(57) ABSTRACT

A hydraulic pump with permanent-magnet motor having a preset direction of rotation, comprising a permanent-magnet motor connected to an impeller with curved vanes which is rotatably accommodated in a volute. The volute is predominantly symmetrical with respect to a line being directed toward an intake port and passing through a rotation axis of the impeller.

3 Claims, 1 Drawing Sheet

HYDRAULIC PUMP WITH PERMANENT-MAGNET MOTOR HAVING A PRESET DIRECTION OF ROTATION

BACKGROUND OF THE INVENTION

The present invention relates to a hydraulic pump with permanent-magnet rotor having a preset direction of rotation.

Conventional hydraulic pumps are already commercially available to which bipolar permanent-magnet motors are applied. Such motors have electronic or mechanical control means which allow to turn the impeller in a specific and preset direction of rotation.

The prior art already uses, as shown in FIG. 1, impellers with curved vanes in which rotation could occur in both directions if other elements were not provided.

If the impeller, designated by the reference numeral 1, turned in the direction in which the vanes 2 are swept backward, a significant flow-rate is in fact obtained with an initial pick-up transient in which the load is constituted by the inertial load of the rotor of the impeller plus the dynamic load due to the energy transferred to the fluid.

With this arrangement, in which the volute 3 of the pump is shaped like an Archimedean spiral, if other measures were not taken the motor might start in the reverse direction, with the vanes swept forward, so that the pump, as shown schematically in FIG. 1, might operate with a greatly reduced flow-rate, i.e., it would deliver a very small flow-rate; with this arrangement, however, the negative torque would in any case be very low and therefore the motor is capable of supporting equally both directions of rotation.

SUMMARY OF THE INVENTION

The aim of the present invention is to solve the above problem, by providing a hydraulic pump with permanent-magnet motor having a preset direction of rotation which allows to obtain a single direction of rotation without having to provide electronic controls, which are particularly complicated and expensive, or mechanical antireversing protrusions which cause the typical drawbacks of breakage, wear and noise.

Within the scope of this aim, an object of the present invention is to provide a hydraulic pump in which it is possible to install larger impellers with an equivalent motor, thus obtaining better results, especially in terms of the head of the pump.

Another object of the present invention is to provide a hydraulic pump which, thanks to its particular constructive characteristics, is capable of giving the greatest assurances of reliability and safety in use.

Another object of the present invention is to provide a hydraulic pump with permanent-magnet motor having a preset direction of rotation which can be easily obtained starting from commonly commercially available elements and materials and is also competitive from a merely economical standpoint.

This aim and these and other objects which will become better apparent hereinafter are achieved by a hydraulic pump with permanent-magnet motor having a preset direction of rotation, according to the invention, which comprises a permanent-magnet motor connected to an impeller with curved vanes which is rotatably accommodated in a volute, characterized in that said volute is predominantly symmetrical with respect to a line being directed toward the intake port and passing through the rotation axis of the impeller.

BRIEF DESCRIPTION OF THE DRAWINGS

Further characteristics and advantages of the present invention will become better apparent from the following detailed description of a preferred but not exclusive embodiment of a hydraulic pump with permanent-magnet motor having a preset direction of rotation, illustrated only by way of non-limitative example in the accompanying drawings, wherein.

DESCRIPTION OF THE PREFERRED EMBODIMENTS

Figure 2:
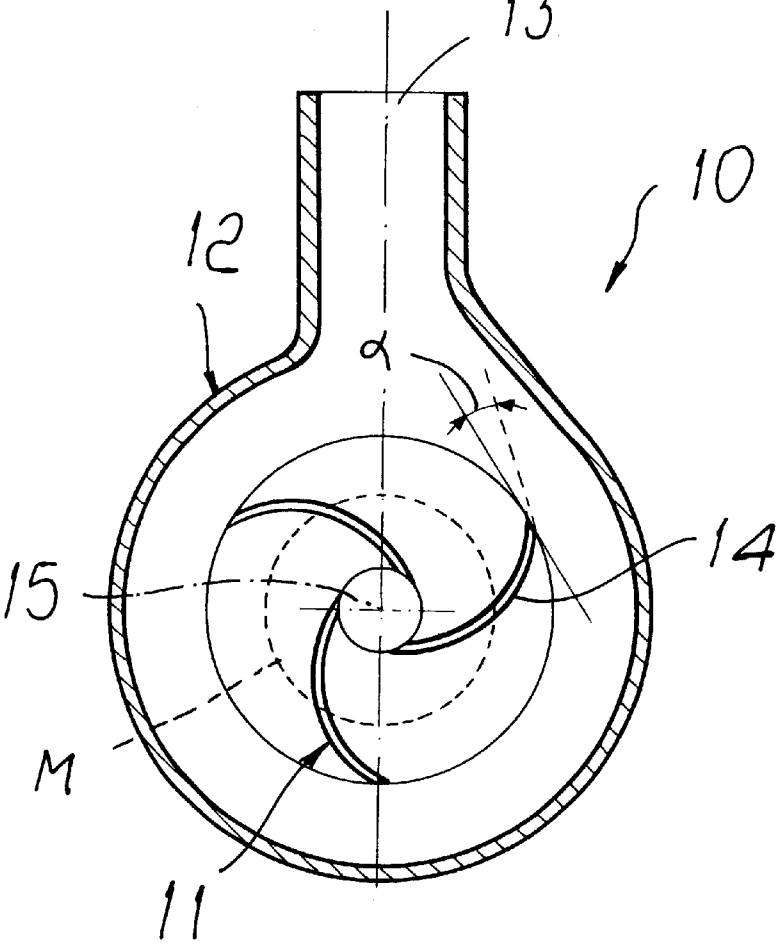
FIG. 2 is a schematic view of the hydraulic pump according to the invention.

With reference to FIG. 2, the hydraulic pump with permanent-magnet motor M having a preset direction of rotation, generally designated by the reference numeral 10, comprises a bipolar permanent-magnet rotor which is operatively connected to an impeller 11 with curved vanes 14, which is arranged inside a volute 12.

The particularity of the invention is constituted by the fact that the volute 12 is almost symmetrical with respect to an imaginary line which connects the discharge port 13 to a rotation axis 15 of the impeller.

By virtue of the prevailing symmetry of the volute of the impeller, if the impeller were to rotate with its vanes swept forward, the fluid, i.e., the water to be pumped, would be subjected to a higher acceleration and most of the energy would be transferred to the fluid in the form of kinetic energy.

During rotation with the vanes swept forward, for a same impeller with a similarly orientated volute, the negative torque is greater than when the impeller turns with its vanes swept backward and is in any case greater than the torque that can be delivered by the motor.

The total load to be turned, which corresponds to the inertial load of the rotor of the impeller plus the dynamic load due to the energy transferred to the fluid, would be very high and therefore the motor would be unable to start; accordingly, in the subsequent cycle rotation reversal would occur, producing rotation with the vanes swept backward, thus obtaining unidirectionality without having to apply electronic controls or mechanical antireversing protrusions.

It has been observed experimentally that the trailing-edge angle $\alpha$, i.e., the angle formed between the direction of an imaginary continuation of the vane and the tangent to the imaginary circle that circumscribes said vane, is preferably less than 30°.

The lower hydraulic load that occurs during rotation with the vanes swept backward allows to turn impellers which have a larger diameter than radial-vane configurations, achieving higher performance and better efficiency.

This type. of effect becomes significant for vanes with trailing-edge angles $\alpha$ of less than 30°.

It should be observed that if the pump is started in air, it might turn in any direction, since it is not contrasted by the fluid, whereas if the same pump is immersed in the fluid for which it is designed the motor will be unable to deliver the required torque for rotation with the vanes swept forward and will automatically reverse its motion, restoring the design conditions.

Figure 1:
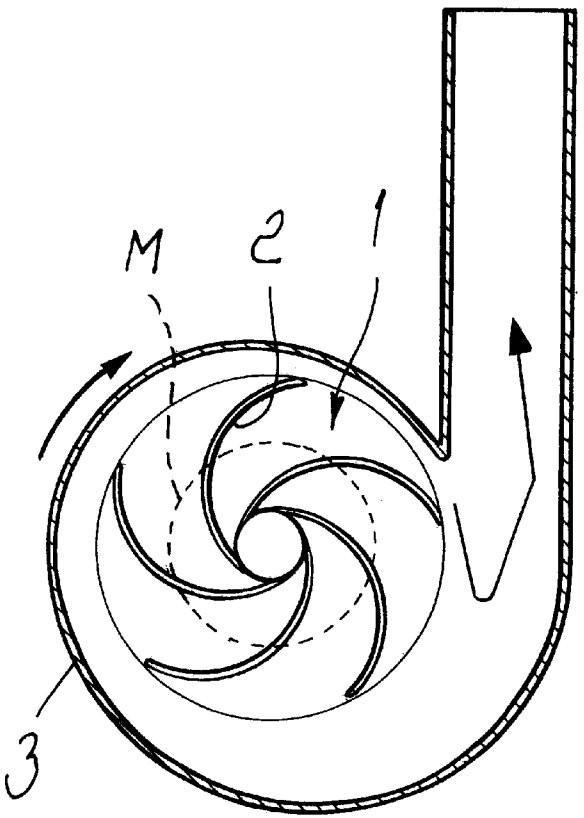
FIG. 1 PRIOR ART
FIG. 1 is a schematic view of a hydraulic pump with a classical Archimedean-spiral volute, according to the prior art.

It is noted that the particular shape of the volute is extremely important, since if one uses the classic Archimedean-spiral volute, as described above for FIG. 1, the pump is still be able to pick up in reverse, reducing its flow-rate considerably but having a negative torque which is equivalent to rotation in the opposite direction with a higher flow-rate.

From the above description it is thus evident that the present invention achieves the intended aim and objects, and that the particular refinements used, i.e., the presence of curved vanes in a volute which has a predominantly symmetrical shape, allows to obtain considerably high hydraulic efficiencies in addition to providing unidirectionality.

The invention thus conceived is susceptible of numerous modifications and variations, all of which are within the scope of the inventive concept.

All the details may further be replaced with other technically equivalent elements.

In practice, the materials employed, as well as the dimensions and the contingent shapes, may be any according to requirements.

The disclosures in Italian Patent Application No. MI2000A000763 from which this application claims priority are incorporated herein by reference.

What is claimed:

1. A hydraulic pump with permanent-magnet motor having a preset direction of rotation, comprising a permanent-magnet motor connected to an impeller with curved vanes which is rotatably accommodated in a volute, wherein said volute is predominantly symmetrical with respect to a line being directed toward a discharge port and passing through a rotation axis of the impeller, and wherein a negative torque of the impeller for rotation with the vanes swept forward is greater than a torque that can be delivered by said motor.

2. The hydraulic pump according to claim 1, characterized in that said impeller with curved vanes has a trailing-edge angle of less than 30°, said trailing-edge angle being determined between a line that lies on a continuation of a free edge of the vane and a tangent to an imaginary circumference that circumscribes the impeller.

3. The hydraulic pump according to claim 1, characterized in that said volute is arranged symmetrically around said impeller.

* * * * *